US005605520A

United States Patent [19]

Chen

[11] Patent Number: 5,605,520

[45] Date of Patent: Feb. 25, 1997

[54] BLOOD VESSEL EXERCISER

[76] Inventor: Chun N. Chen, No. 3, Lane 232, Sec. 2, Kuai Yang St., Taipei, Taiwan

[21] Appl. No.: 557,561

[22] Filed: Nov. 14, 1995

[51] Int. Cl.[6] ..... A63B 23/14

[52] U.S. Cl. ..... 482/46; 482/110

[58] Field of Search ..... 482/81, 82, 92, 482/93, 109, 110, 131, 139, 148, 45, 46

[56] References Cited

U.S. PATENT DOCUMENTS 3,062,543 11/1962 Shaboo et al. ..... 482/110
4,869,491 9/1989 Nolan ..... 482/93 X

*Primary Examiner*—Linda C. M. Dvorak
*Assistant Examiner*—John Mulcahy
*Attorney, Agent, or Firm*—Morton J. Rosenberg; David I. Klein

[57] ABSTRACT

A blood vessel exerciser is provided that is formed by a long length of tubular material that is ergonomically curved. The exerciser includes a middle curved surface section, two curved arc sections, and two handles. The two curved arc sections are located on the opposing ends of the middle curved surface section, with two handles so that the two handles are formed symmetrically with respect to the middle curved surface section. A bushing is installed on each of the two handles at the two ends of the blood vessel exerciser, and freely move about the handles, so that the user can grip the blood vessel exerciser and then rotate it positively or negatively.

1 Claim, 5 Drawing Sheets

BLOOD VESSEL EXERCISER

FIELD OF THE INVENTION

The present invention is directed to a blood vessel exerciser. More in particular, the present invention is directed to a blood vessel exerciser which is inventive, practical and its structure is simple, compact and is ready for a user to grip for exercising the arms.

PRIOR ART

According to medical reports related to the Chinese Book of Changes, if the blood vessels throughout the human body are properly trained and stimulated, the blood circulation will be increased and health is thereby also improved. In the busy industrial society of today, whatever work one is engaged in, since such is often long and fixed, the muscles and bones are not evenly developed. This situation decreases the range of motion of the human body. So if the arms do not exercise properly, the arms will be uncomfortable because of poor blood circulation, and then the rear of the neck will suffer from pressure, inducing headaches. Moreover, the eyes and the face will also feel uncomfortable. Especially for old persons, this phenomenon is generally found. So some exercises suited for the old are suggested, for example, an exercise to vibrate the hands, such as by gripping two balls in the hands and swirling them around to improve blood circulation in the hands and the palms.

Another method for reducing depression is to use proper exercising devices for exercising the hands and legs. But the general outdoor exercises, for example, running, ball games, etc., are too drastic to suit all persons. The generally used indoor exercising machines, for example, running machines, weightlifting machines and so on, have the defect of being of large volume and weight and a particular room is needed for locating such exercising machines. Also, such drastic exercises are not suited for women. The recently popular massage devices are mainly directed to massaging the muscles of different portions of the human body, it is rarely found that those devices are designed for massaging the two arms.

So, it is needed to have a simple and compact exercising machine which is provided for moderately exercising the two arms, and is also space saving. An exerciser, especially the workers, women, and the old, needs to have another method of exercise. However, exercise machines having the features described above have heretofore not been discovered.

SUMMARY OF THE INVENTION

Accordingly, in order to achieve the object described above, the present invention provides a blood vessel exerciser, especially, a simple and compact blood vessel exerciser which is provided for moderately exercising the two arms, and is also space saving. That is to say, the object of the present invention is to provide a blood vessel exerciser which is formed from a long curved tube, so, it is space saving and can be readily used and easily stored.

Another object of the present invention is to provide a blood vessel exerciser the shape of which is designed to form a curved ergonomic shape that the user can rotate positively or negatively by using one hand or two hands. Therefore, the object of exercising two arms by using a moderate method of exercise is achieved.

BRIEF DESCRIPTION OF THE DRAWINGS

This invention can be best understood by reference to the following diagrams and the description of the preferred embodiments, in which.

DESCRIPTION OF THE PREFERRED EMBODIMENT

Figure 1:
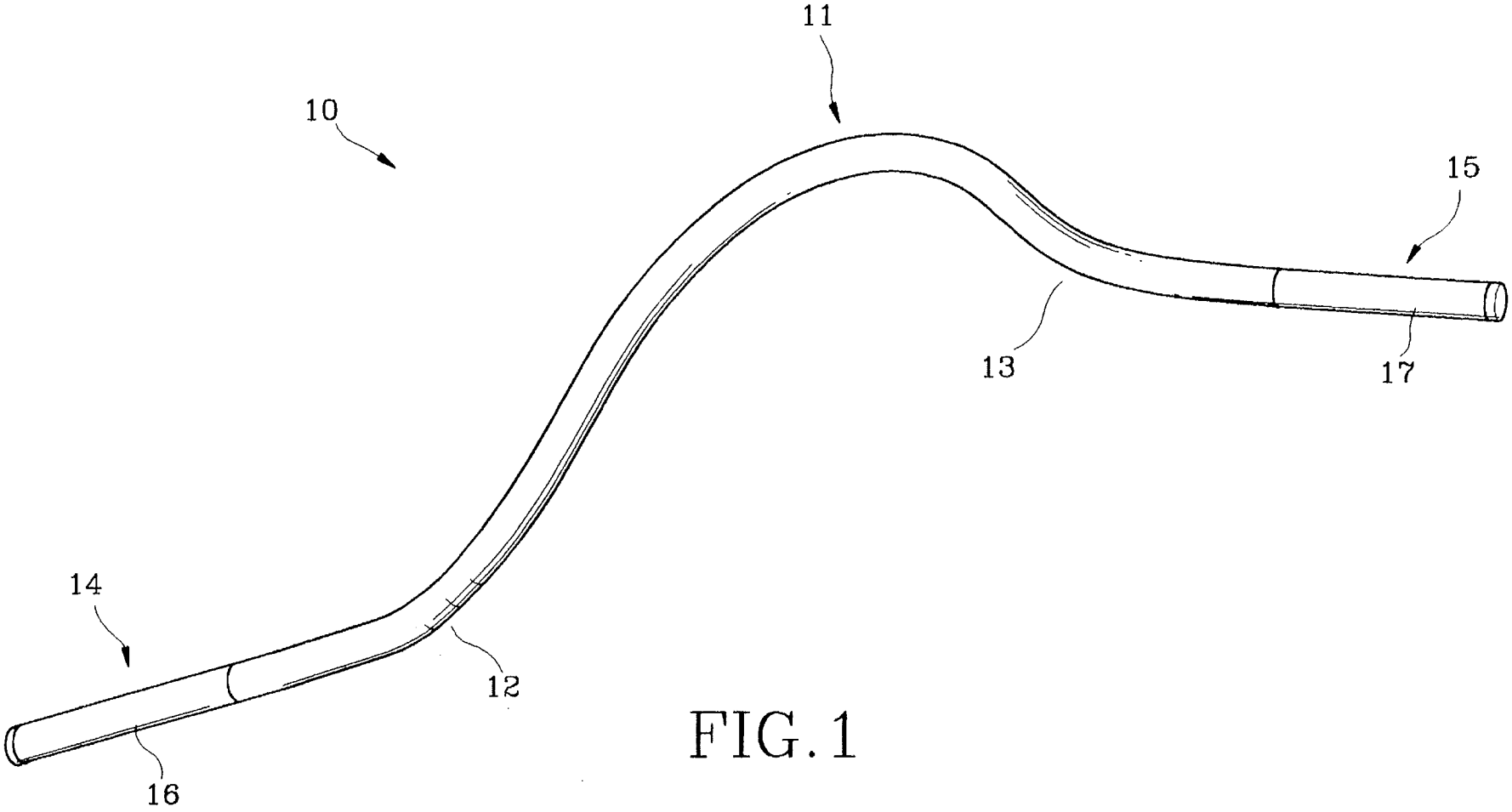
FIG. 1 is a perspective view of the blood vessel exerciser of the present invention.

Referring to FIG. 1, the blood vessel exerciser of the present invention is formed by a long length of tubular material that is properly curved according to ergonomics to comprise a middle curved surface section 11, two curved arc sections 12, 13, and two handles 14, 15.

Figure 2:
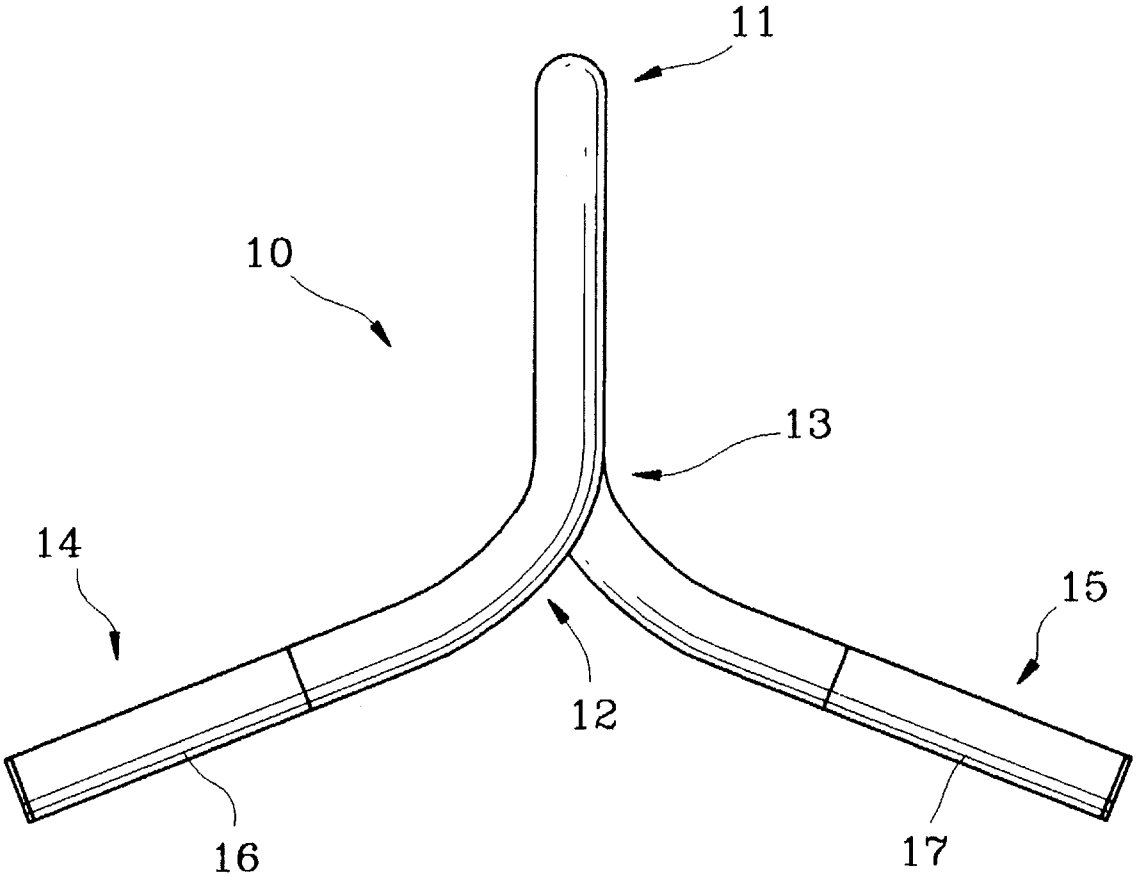
FIG. 2 is the front elevation view of the blood vessel exerciser of the present invention.
Figure 3:
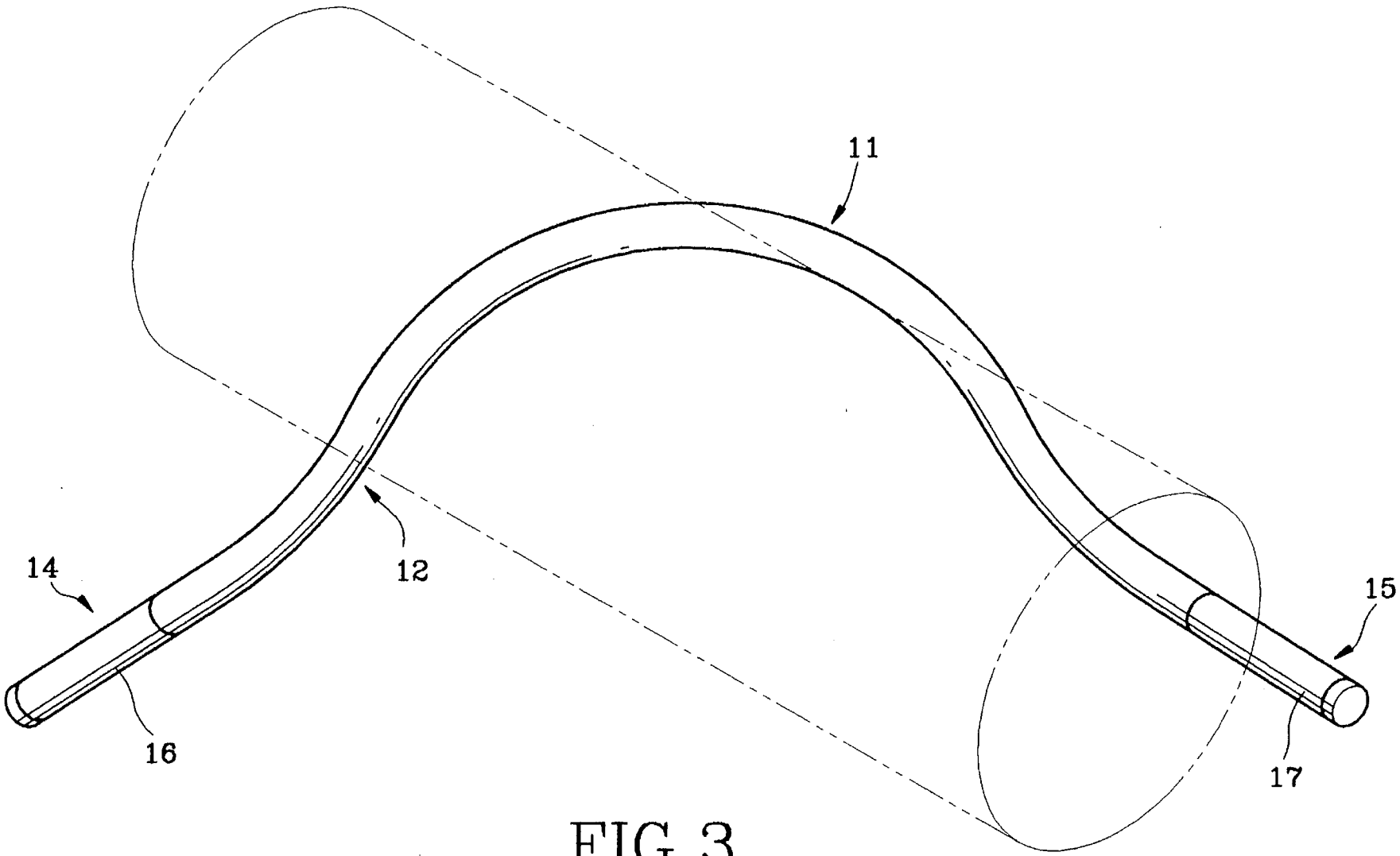
FIG. 3 is a perspective view of the blood vessel exerciser of the present invention with a schematic representation of the curved contour.
Figure 4:
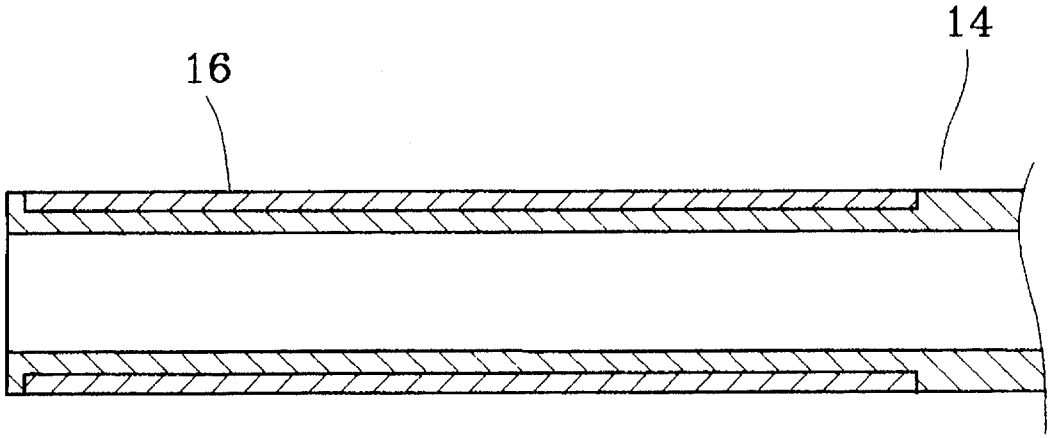
FIG. 4 shows a cross-section of the handle portion of the present invention; and, FIG. 5 depicts usage of the present invention.

Referring now to FIGS. 2 and 3, the curved surface section 11 of said blood vessel exerciser 10 is disposed in the middle section of said blood vessel exerciser and is formed in a substantially semicircular contour. The two curved arc sections 12, 13 are respectively located on the two ends of the middle curved surfaces, but extend therefrom in opposing directions and extend in a direction transverse the plane of the curved surface section 11. Two handles 14, 15 are connected, respectively, to the two curved arc sections, with the two handles being formed symmetrically with respect to the middle curved surface section 11. The angular extent of the two curved arc sections are the same, one with respect to the other.

Two bushings 16 and 17 are installed, respectively, on the two handles 14, 15 at the two ends of the blood vessel exercisers 10. The cross-section of the bushings on the handle is shown in FIG, 4. The two bushings 16, 17 are installed on respective handles 14 and 15 so as to freely move about the handles so that the user can grasp the blood vessel exerciser.

Figure 5:
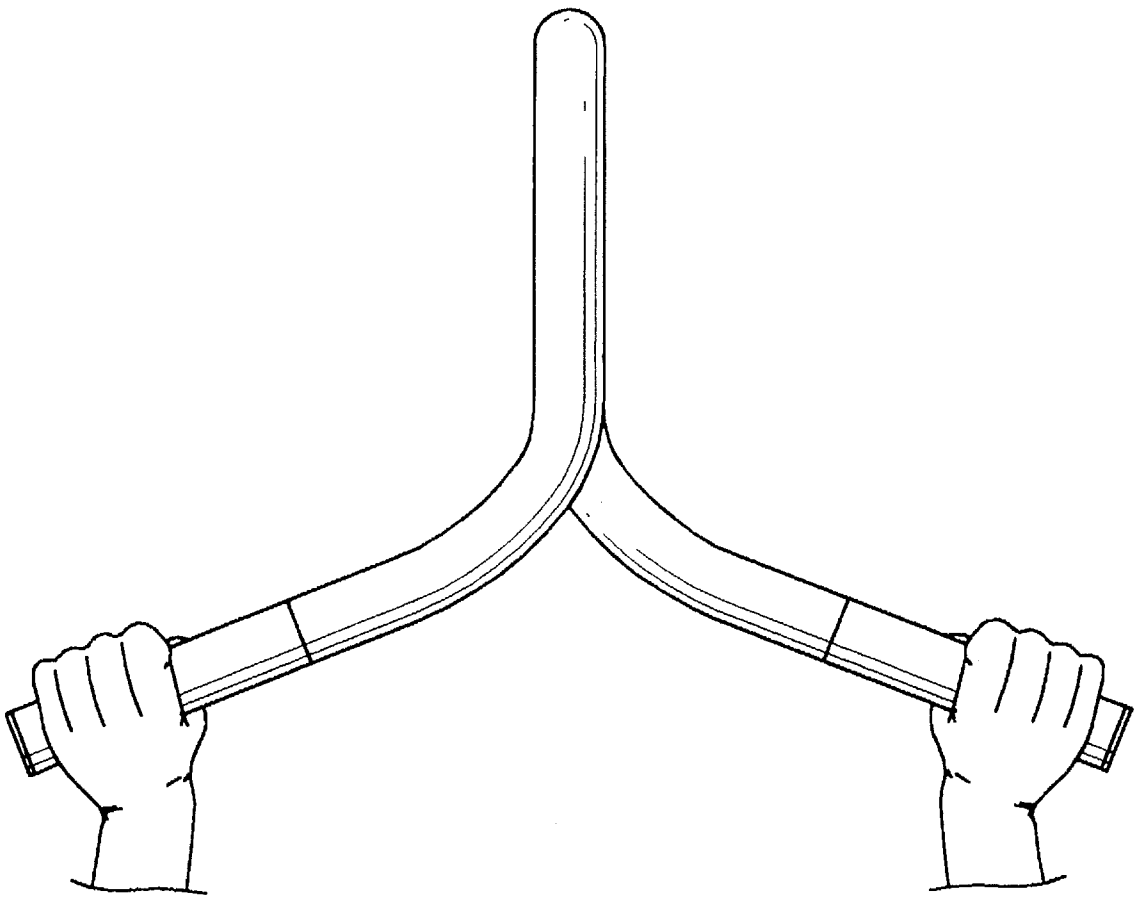

As shown in FIG. 5, when operating the blood vessel exerciser 10, the two hands of a user grasp the bushings 16 and 17 at the ends of the two handles, and then rotate the center section positively or negatively. Alternately, only one hand of the user grasps one bushing of one handle, and also rotates the center section positively or negatively. Now, the rotational arc of the middle curved section of the blood vessel exerciser 10 presents a circular rotation, due to rotation about the handles 14, 15. The angle formed by the curved arc sections 12 and 13, between the two end handles 14 and 15 and the middle curved surface section will cause the two end handles to form different angular variations as the middle curved surface section rotates responsive to different rotary speeds. Because of the rapid variation of the gripping angle, a massage effect is attained.

Because the blood vessel exerciser 10 is compact and saves space, it therefore can be readily used and stored. The operation of the present invention is simple and the speed for controlling rotation can be adjusted as required, and at any time, so everyone can control it. The rotational speed is quick, but the variation at the handles is slow, so the extend of the stimulation about palms, joints and arms is adjustable.

Therefore, the effects of exercising muscles and massaging blood vessels are attained through the use of exerciser 10. Thus, the present invention is a controllable and moderate exerciser.

In manufacturing, the angle and direction formed by the curved arc section 12, 13 between the two end handles 14 and 15 and the middle curved surface section 11 can be varied so as to meet different specifications.

Therefore, the blood vessel exerciser described above is formed with a simple structure, is easy to manufacture, and is compact and convenient to operate. Anyone who can control rotation actions is suited to operate the exerciser. Thus, the object of exercising the muscles and blood vessels of their two arms and two palms is achieved.

I claim:

1. An exercise device for stimulating the blood circulation in a user's arms and hands, comprising a long continuous length of tubular material having a central portion formed in a longitudinally directed semicircular contour, said continuous length of tubular material having two curved arc sections respectively formed on opposing ends of said central portion and extending symmetrically in opposing directions transverse said longitudinal direction, each of said two curved arc section having a handle portion formed adjacent a distal end thereof; and a pair of bushings, each of said pair of bushings being rotatably coupled to a handle portion of respective one of said two curved arc sections, said two curved arc sections extending from said central portion at a predetermined angular extent for causing a variation in relative positioning of said handle portions as a user displaces said central portion in a circular rotational trajectory.

* * * * *